US005152026A

United States Patent [19]

Scarpine

[11] Patent Number: 5,152,026

[45] Date of Patent: Oct. 6, 1992

[54] COOLING TOWER CLEANING DEVICE

[76] Inventor: Philip F. Scarpine, 313 Camarillo St., Suite D, Placentia, Calif. 92670

[21] Appl. No.: 766,108

[22] Filed: Sep. 27, 1991

[51] Int. Cl.[5] ..... F04F 10/00

[52] U.S. Cl. ..... 15/1.7; 137/123

[58] Field of Search ..... 15/1.7, 398, 401; 137/123, 153

[56] References Cited

U.S. PATENT DOCUMENTS

| | | | |
|---|---|---|---|
| D. 244,937 | 7/1977 | Houk . | |
| D. 284,603 | 7/1986 | Loignon . | |
| 2,131,743 | 10/1938 | Loughridge . | |
| 2,197,509 | 4/1990 | Reilly et al. . | |
| 2,977,613 | 4/1961 | Mikulas | 15/107 |
| 4,414,997 | 11/1983 | Jacobson et al. . | |
| 4,574,828 | 3/1986 | Brumfield . | |
| 4,797,206 | 1/1989 | Lynch | 15/1.7 X |

*Primary Examiner*—Gerald A. Michalsky

*Attorney, Agent, or Firm*—Gordon K. Anderson

[57] ABSTRACT

A siphon transfer, cooling tower sump water cleaning device, which has a cleaning nozzle attachment (20) connected to an extension tube (32) and a collecting chamber (44). The collecting chamber has a drain hose (52) threadably attached on the end and the entire device is placed under the sump water (38) of a cooling tower (34) for priming. The hose is placed below the water level and the nozzle is scrubbed against the bottom of the cooling tower sump (36). As debris and foreign matter is dislodged and is in solution with the water siphon action takes place drawing the mixture into the tube (32). At the end of the tube the inside diameter increases slightly in the collecting chamber and abruptly, yet smoothly, increases the velocity pressure in an elipsoidal shaped converging nozzle (50) where the increased velocity draws the debris through the remaining hose (52).

8 Claims, 3 Drawing Sheets

COOLING TOWER CLEANING DEVICE

TECHNICAL FIELD

The present invention relates to cleaning devices using a siphon for transferring liquids in general. More specifically to a siphon transfer cooling tower sump water cleaning device for removing debris and foreign matter from the bottom of a wet deck cooling tower.

BACKGROUND ART

Others have attempted to use hoses filled with water using the siphon principle to clean out the sump of a cooling tower, however, the sediment and heavy particles still remain on the bottom and insufficient negative pressure is created to properly clean the sump. Prior art has, however, used the siphon principle in conjunction with other mechanisms to accomplish a variety of tasks, some pumping by hand to fill the hose and start the siphon, others using check valves for the same purpose. Still others combine the venturi principle with a siphon to draw liquids from another source.

A search of the prior art did not disclose any patents that read directly on the claims of the instant invention, however, the following U.S. Pat. Nos. were considered related:

| Patent No. | Inventor | Filing Date |
|---|---|---|
| DES 284,603 | Loignon | Jul. 8, 1986 |
| DES 244,937 | Houk | Jul. 5, 1977 |
| 4,574,828 | Brumfield | Mar. 11, 1986 |
| 4,414,997 | Jacobson et al | Nov. 15, 1983 |
| 2,197,509 | Reilly et al | Apr. 16, 1940 |
| 2,131,743 | Loughridge | Oct. 4, 1938 |

Loignon in U.S. Pat. No. Des. 284,603 presents a siphon fitting with a cone-like coverging throat and a side outlet interfacing at the vena contracta of the throat followed by a diverging nozzle apparently for drawing fluids into the mainstream by the siphon effect.

U.S. Pat. No. Des. 244,937 issued to Houk teaches a similar device, as above, with a side fitting entering a tube with cone-like converging section followed by a section of lesser size obviously increasing the velocity of a fluid drawn from the side fitting.

Brumfield in U.S. Pat. No. 4,574,828 has a hand operated pump and siphon having a pair of telescoping hollow tubes that reciprocate one with the other. A valve at each end holds the fluid inside and seal due to pressure differentials within. Siphoning occurs when the angle is rotated, therefore, no separate priming is necessary.

U.S. Pat. No. 4,414,991 of Jacobson et al disclose a siphon for transferring fluid using a one-way check valve on one end of a tube. The device is inserted into a container with liquid present and by shaking the tube up and down, the fluid fills the hose and flows by gravity therethrough.

Reilly et al presents a complex apparatus for separating solids from sewage in U.S. Pat. No. 2,197,509 wherein gravitational forces move the liquid from one chamber to the other with the solids collected in a hopper at the bottom.

U.S. Pat. No. 2,131,743 issued to Loughridge employs a venturi siphon using an air blast from a pump, or the like, to start the flow of fluid. Other elements are added, such as a float valve, storage tank, etc., for dispensing liquids.

In searching the prior art, no specific siphons were found that used collecting chambers with smooth walled converging nozzles to maintain and encourage entrainment of debris by increasing velocity within a tube.

DISCLOSURE OF THE INVENTION

Previously, industrial type cooling towers using a combination of heat and mass transfer distributing water by spray, splash, or filming expose a large surface to atmospheric air. Although a portion of the water absorbs heat changing it to a vapor at constant pressure, the remaining water maintains its liquid state and accumulates in the bottom of the tower in a sump made for that purpose. In time debris and foreign matter accumulate in this sump and if not removed, contaminate the water and obstruct the liquid pump that recirculates the water. Conventionally, the towers are completely drained and the sump scrubbed or, in some cases, a pump with the inlet attached to a hose is utilized to vacuum the sump without removing all of the water. The problems of economically cleaning the sump have been with us for a long time, however, with labor becoming more costly and materials likewise increasing in price, a solution is not only vitally needed but welcomed in the industry.

With this in mind, it is a primary object of the invention to save considerable amounts of water by not completely draining the sump. In some forced draft cooling towers used for conventional building air conditioning as much as 2000 gallons is required for each cooling tower. The invention allows a maintenance engineer to completely clean the sump by draining only a small portion of the water, as the scrubbing action of the cleaning nozzle loosens the debris and the suction of the water through the device is more than adequate to carry the particles agitated by the scrapping action away through the hollow handle. The velocity of the water and the shape of the collecting chamber maintains the particles in suspension including heavy objects such as rust or plating flaked off of the structure within the cooling tower. It has been found in testing numerous types of cooling towers with the invention that about one eighth of the water within the sump requires removal for adequate cleaning of the entire bottom.

An important object of the invention is the fact that the water saved by itself may not be expensive, however, cooling tower water requires costly chemical treatment. As water evaporates in a cooling tower the dissolved solids originally present in the water remain in the system. The concentration of these dissolved solids increases rapidly causing scale and corrosion. In addition, airborne impurities and biological contaminants including Legionella, may be introduced into the recirculated water. Biocides and specially formulated chemicals counteract this build-up and maintain the PH somewhere between 7.0 and 9.0. The water treatment program must be employed for the fresh water added to the system making cleaning expensive if the entire tower sump must be drained. If everytime the system required cleaning, which varies considerably with the location and ambient conditions, costly treatment is required. It can be appreciated that in a period of time considerable expense may be avoided using the invention for the cleaning method.

Another object of the invention is energy saving as some cleaning systems include an electric motor driven pump that elaborately draws water and debris from the bottom of the sump, filters it and returns it to the system. While this type of apparatus ultimately saves the chemical treatment of the water, not all towers have low voltage electrical outlets close enough to be practical and the heavy device must be carried by hand to the site, usually on the roof. It should also be noted that the original expense of the pump motor, filters, hoses, and associated piping must offset the savings in chemicals and the manpower is about the same as required by the instant invention. Consideration must also be given to the simplicity of the invention using natural forces to drain the water with absolutely no energy consumed and the initial cost extremely low by comparison.

Still another object of the invention is that the cooling tower need not be shut down to be cleaned. Normally, when the tower is drained for cleaning the entire air conditioning system is deenergized, therefore, this procedure must be accomplished during off-hours, such as week-ends, where maintenance labor is at a premium. The advantages of the invention are clearly seen in this area.

A further object of the invention is that during the cleaning procedure the user has a visual display of its effectiveness. The flexible drain hose attached to the collecting chamber is made of clear plastic, allowing the operator to explicitly see the amount of debris present in the water indicating that the area being scrubbed needs further effort or the cleaning nozzle should be moved to a new location. This simple but effective indication save considerable effort and is time efficient maintaining the cleaning time at an absolute minimum.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
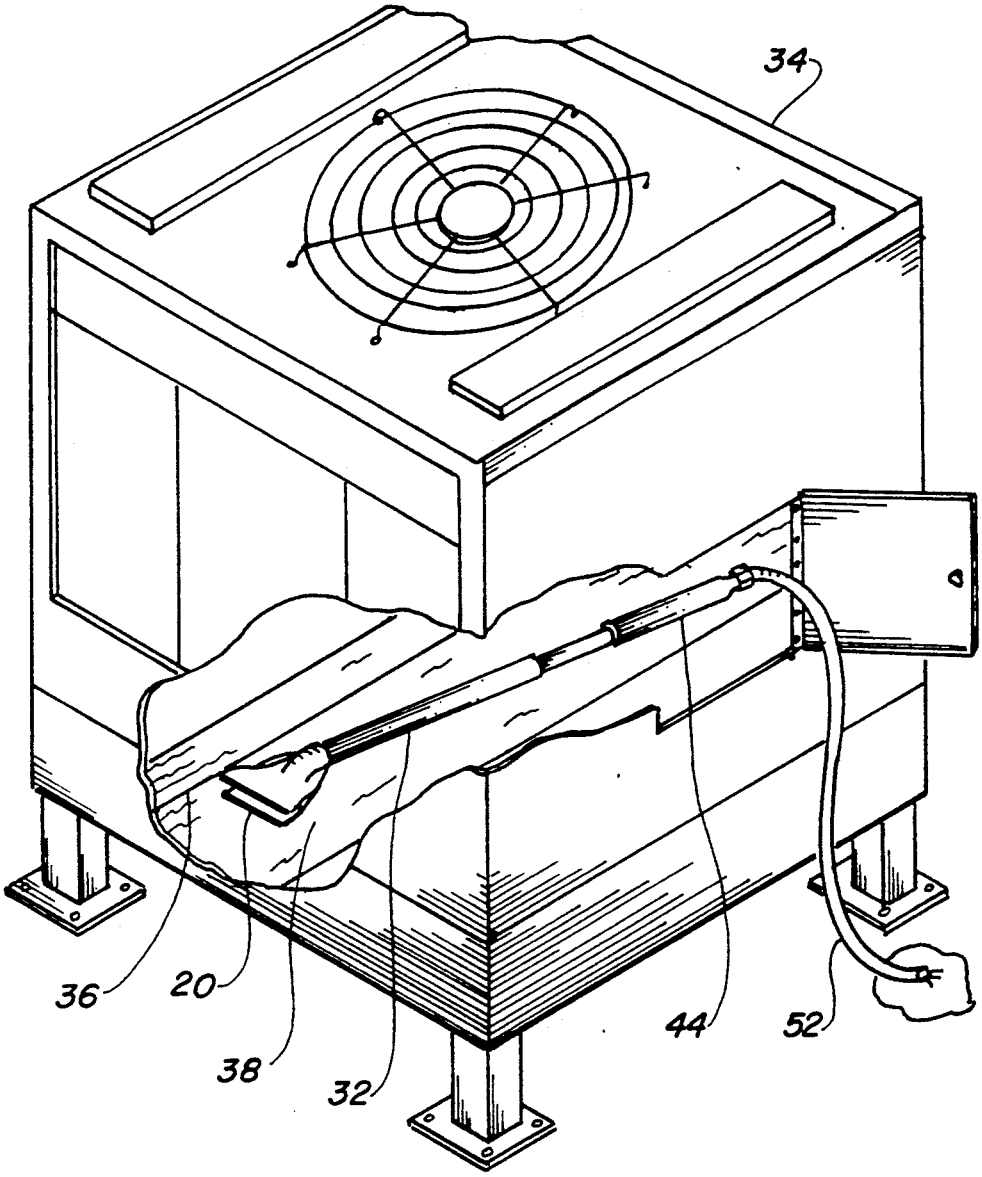
FIG. 1 is a partial isometric view of the preferred embodiment shown inside a cooling tower as it would be applied in the cleaning mode having already been primed and siphoning water from the sump.
Figure 2:
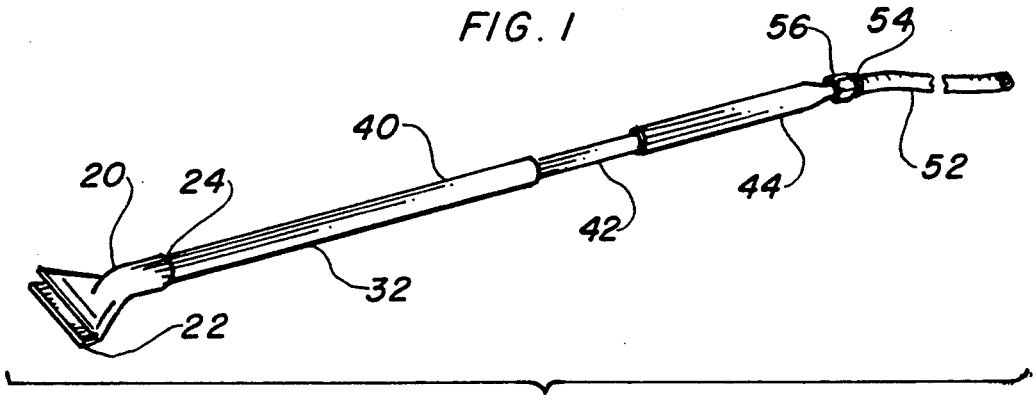
FIG. 2 is a partial isometric view of the preferred embodiment with the drain hose partially cut-away for clarity.
Figure 9:
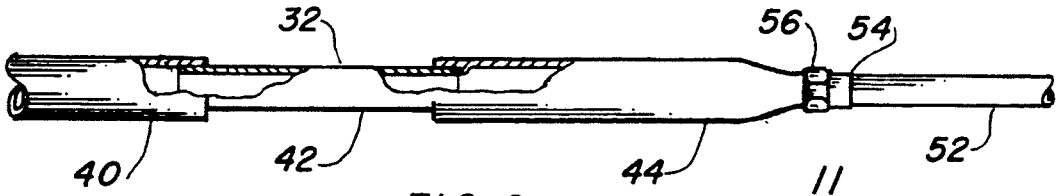
FIG. 9 is a fragmentary cross-sectional view of the preferred embodiment cut-away along the centerline of the invention.
Figure 10:
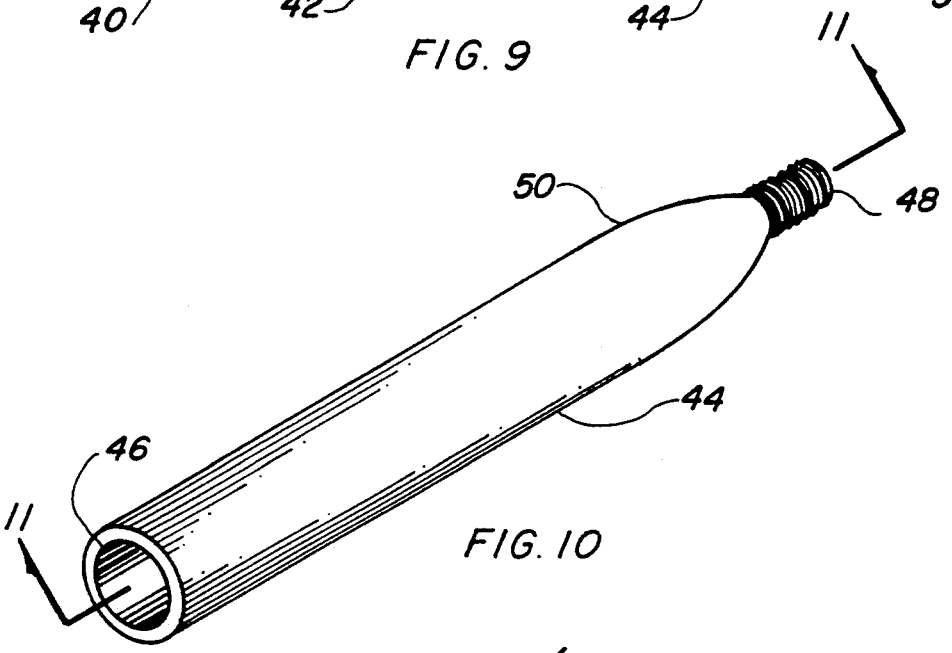
FIG. 10 illustrating the outside of the collecting chamber completely removed from the invention.

The best mode for carrying out the invention is presented in terms of a preferred embodiment with optional cleaning nozzles.

The preferred embodiment, as shown in FIGS. 1 through 12 is comprised of a hollow removable cleaning nozzle attachment 20, preferably made of thermoplastic formed by injection molding. The cleaning nozzle 20 may be in different forms and shapes for specific purposes, such as illustrated in FIGS. 3 through 8, all of which have an inlet 22 and an outlet 24 with the inlet shaped to scrape or brush deposited debris and foreign matter into the sump water where it may be drained through the device.

Figure 3:
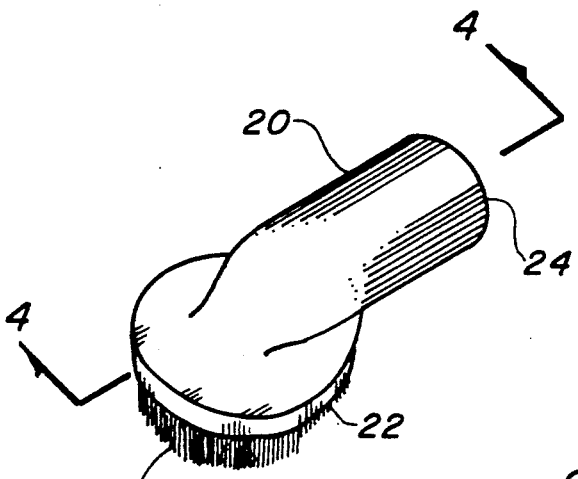
FIG. 3 is a partial isometric view of a cleaning nozzle having a brush attached to the periphery of the inlet opening.
Figure 4:
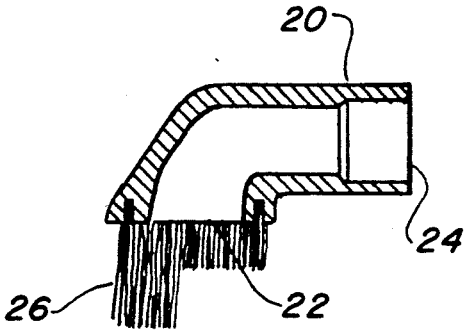
FIG. 4 is a cross-sectional view taken along lines 4—4 of FIG. 3.

FIGS. 3 and 4 illustrate the embodiment having a brush 26 integral with the cleaning nozzle 20 around the lower perimeter. The brush 26 may be stepped, as shown in FIG. 4, or may extend outwardly the same distance with equal ease. At any rate, the bristles of the brush 26 working in concert dislodge and stir up the deposits sufficiently to achieve the desired results.

Figure 5:
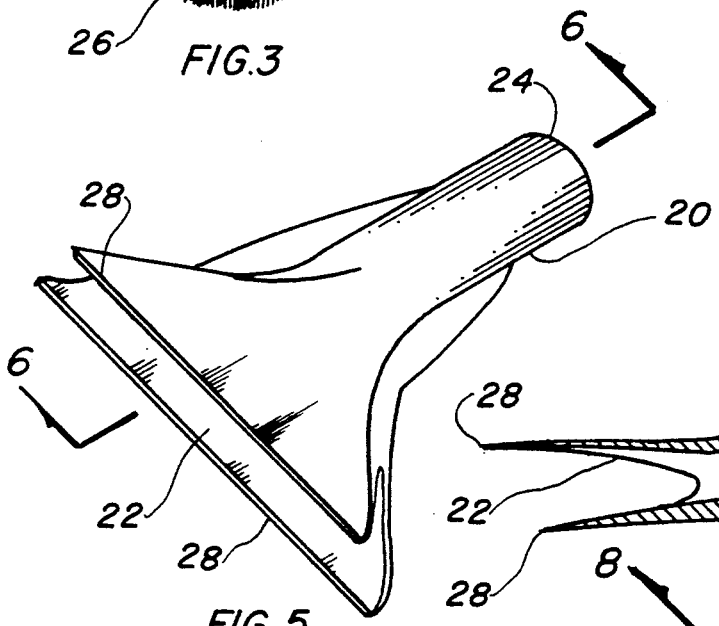
FIG. 5 is a partial isometric view of a cleaning nozzle containing an outwardly flared dual lip used for scraping.
Figure 6:
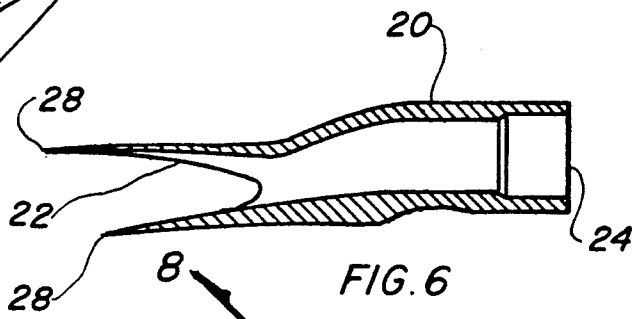
FIG. 6 is a cross-sectional view taken along lines 6—6 of FIG. 5.

An embodiment wherein the cleaning nozzle 20 is configured with a dual lipped outwardly flared scraper 28 is depicted in FIGS. 5 and 6. The dual lips are parallel and form a throat on the inlet end which allow scraping with either lip or both lips simultaneously. The narrowness of the throat on the inlet 22 and the instant taper toward the outlet end 24 permits the particle ladened water to be drawn into the nozzle under sufficient negative pressure to provide efficient removal from the sump.

Figure 7:
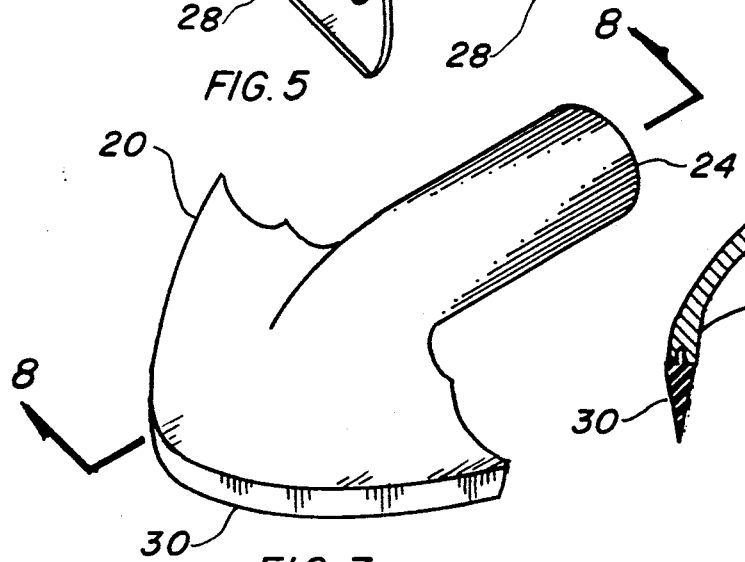
FIG. 7 is a partial isometric view of a cleaning nozzle having a pair of squeegees in a radially flared shape.
Figure 8:
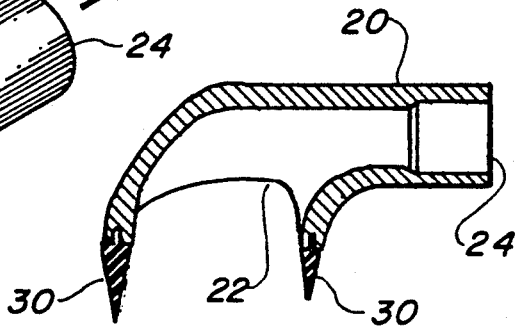
FIG. 8 is a cross-sectional view taken along lines 8—8 of FIG. 7.

Another embodiment is illustrated in FIGS. 7 and 8 and depicts a nozzle 20 having a squeegee 30 on an irregular shaped radial periphery. The squeegee 30 may be continuous or in sections and its shape may be irregular enough to dislodge debris while forming a tight chamber taking advantage of the maximum amount of suction head created by the siphon effect in the device.

One or more hollow extension tubes 32 are connected to the nozzle attachment 20 on the outlet end 24 for lengthening the device sufficiently to permit manual handling of the invention from the outside of a cooling tower 34. The length of this tube 32 is preferably one quarter to one third the width of a cooling tower sump 36 which ideally provides the optimum length for the operator to insert entirely within the cooling tower 34. This length also permits submerging the entire device in the sump water 38 for priming and is also long enough to reach the entire area for convenient cleaning from the outside.

In order to increase the velocity within the extension tube 32 just prior to its exit, the tube 32 is preferably divided into two sections, a first extension length 40 and a second extension length 42. The first length 40 has an inside diameter just slightly larger or almost the same size as the outside diameter of the second length allowing the two to be attached by a frictional interference fit. The first length 40 is from 75 to 80 percent longer than the second length 42 with the diameter and length difference slightly increasing the velocity within the second length 42 for a short duration thus maintaining suspension of the debris and foreign matter in the sump water 38 flowing therewithin.

Figure 11:
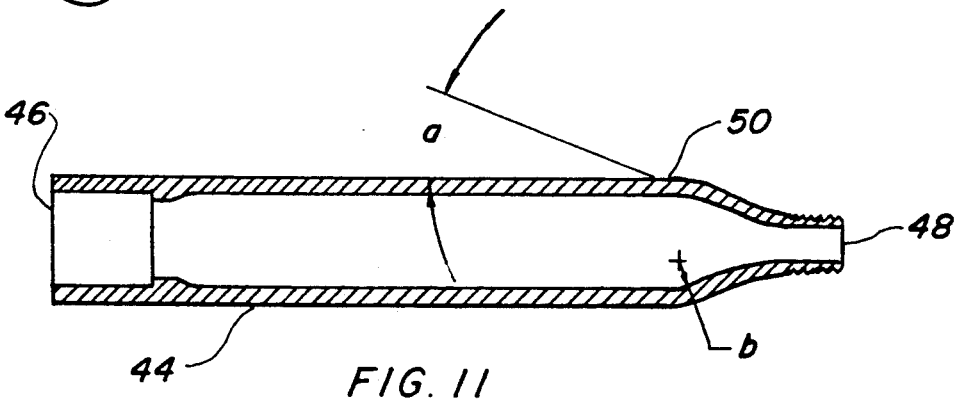
FIG. 11 is a cross-sectional view taken along lines 11—11 of FIG. 10.
Figure 12:
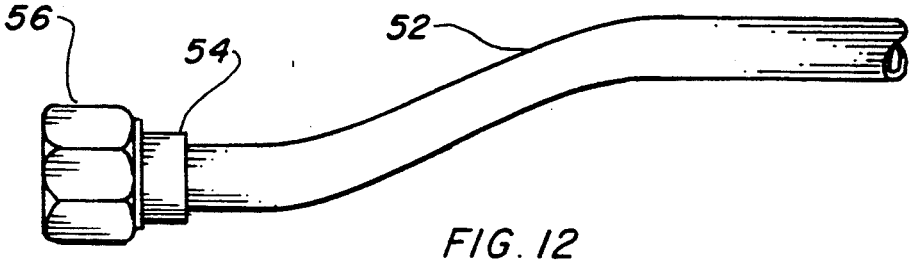
FIG. 12 is a fragmentary view of the connecting end of the drain hose illustrating the method of attachment.

The key to the invention is found in a hollow collecting chamber 44 having an internal diameter from 13 to 15 percent larger than the internal diameter of the second extension length 42. The chamber 44 is formed with a front or first end 46 and a rear or second end 48. The front 46 has a socket to receive the second extension pipe 42 in a slip fit forming a frictional interface. The length of the chamber 44 on the inside has a ratio of from 7:1 to 8:1 length to internal diameter and the second or rear end 48 is formed with a smooth converging nozzle 50. This integral nozzle 50 has an angle of convergence of from 15 to 25 degrees, as illustrated in FIG. 11, and is designated "a" in the sectional view. This nozzle 50 is further in an elipsoidal shape similar to one quarter of an elipse of from 28 to 32 degrees designated "b" in FIG. 11. At any rate, this converging nozzle 50 is smooth in both its entrance and exit and allows a slight decrease in velocity for a short, space and then evenly and uniformly increases the velocity pressure until the cross-sectional area has decreased by approximately one third, or from 30 to 40 percent in tested efficiency. As the combined velocity increase at the vena contracta of the nozzle and the elipsoidal shape propel the debris laden sump water into a reduced cross-sectional area the material in suspension is retained and is not separated, allowing the device to cleanly remove the foreign matter and transfer it away from the cooling tower. The extension tubes 32 and chamber 44 may be of any type of material suitable for the purpose, however, thermoplastic is preferred, such as polyvinyl chloride, polycarbonate, polyethylene, polypropylene, and a myriad of others.

A drain hose 52 is removably attached to the second end or rear 48 of the collecting chamber 44. Like the terminus of the converging nozzle, the hose is from one half to one third smaller than the collecting chamber 44 internal diameter. The hose 52 is the same internal diameter throughout its length maintaining a constant velocity and almost the same static head, less frictional losses of course. The hose 52 is preferably clear or transparent allowing visual indication of the effectiveness of the cleaning device and the type and amount of debris in suspension within the sump water. A thermoplastic material is preferred, such as a clear polyvinyl chloride, polyurethane, polyethylene and polypropylene, etc., with the later two marginally acceptable as they are translucent only. Other formulations may be used with equal ease, such as so-called TYGON as it is known by its registered tradename as manufactured by Norton Industrial Plastics, or other specialized formulations and brand names.

The nozzle 20 employs a frictional fit to the extensions 32 and the extensions themselves 40 and 42 are preferably fit in the same manner, except a cement is used to maintain a watertight joint. Similarly the connection between the tube 32 and collecting chamber front 46 uses some type of cement, or the like, to maintain its watertight integrity. The connection between the rear or second end 48 of the chamber 44 is made using threads and a fitting 54, as shown in FIGS. 9 through 12. The chamber 44 employs male threads and the fitting 54 uses a female nut 56 to which the hose 52 is attached using a barbed adapter or a compression seal. Any type of hose connection, well known in the art, may be used with equal ease.

In use, the cleaning device is placed inside the cooling tower 34 and submerged in the sump water 38 to prime the inside and replace the air with a solid head of water. Sometimes it is necessary to move the device angularly to and fro to eliminate trapped air. While the cleaning nozzle 20 remains submerged the drain hose 52 is taken out and place below the water level on the floor, roof or directly into a drain and the sump water begins to flow by gravity. The device is held manually and the cleaning nozzle 20 is scrubbed against the sump 36 dislodging the material on the bottom. When cleaning is completed, the nozzle 20 is lifted out of the water and it empties by gravity feed.

While the invention has been described in complete detail and pictorially shown in the accompanying drawings, it is not to be limited to such details, since many changes and modifications may be made in the invention without departing from the spirit and the scope thereof. Hence, it is described to cover any and all modifications and forms which may come within the language and scope of the appended claims.

I claim:

1. A siphon transfer cooling tower, sump water cleaning device comprising:

a hollow removable cleaning nozzle attachment tool having an inlet and an outlet with the inlet shaped such that debris and foreign matter may be scraped from the cooling tower sump bottom and be drawn by siphon effect into the hollow nozzle in solution with the sump water for removal to a lower elevation, at least one hollow extension tube secured to the outlet of the cleaning nozzle lengthening the device sufficiently to permit manual cleaning from the outside of a cooling tower, said extension tube further comprises, a first extension length and a second extension length with the first length having an inside diameter almost the same as the outside diameter of the second length and both lengths attached together by slideably urging the second length into the first length forming a frictional interface fit, a hollow collecting chamber having a first end and a second end, the chamber hollow slightly larger than the extension tube, further secured on the first end to the extension tube, and the second end having a smooth converging nozzle integral therewith for ultimately increasing velocity pressure of the sump water to draw and retain debris and foreign matter in suspension into the second end where it may be expelled, said collecting chamber further having a decrease in cross-sectional area from 30 to 40 percent from the chamber inside to the converging nozzle outlet, therefore, increasing water velocity therethrough, said collecting chamber further having an internal diameter from 13 to 15 percent larger than the second extension length internal diameter for decreasing velocity and permitting turbulance of debris in solution, said collecting chamber further having a length to internal diameter ratio of from 7:1 to 8:1, said collecting chamber further having an elipsoidal shape in the converging nozzle of from 28 to 32 degrees with a smooth entrance and exit therefrom; and a drain hose removably attached to the second end of the collecting chamber having a size from one-half to one-third smaller than the collecting chamber maintaining an increased velocity within the hose while retaining almost the same static head compelling the debris and foreign matter in suspension in the sump water to continue through the hose for final disposal thereof.

2. The cleaning device as recited in claim 1 further comprising at least one brush attached to the inlet of the removable cleaning nozzle to sweep debris from the cooling tower sump into suspension in the water for transferring by siphon through the cleaning device.

3. The cleaning device as recited in claim 1 wherein said cleaning nozzle further having a dual lipped outwardly flared scraper forming a parallel slotted throat on the inlet end for dislodging debris from the cooling tower sump using manual scraping causing the debris to rise in suspension in the water for transferring by siphon through the cleaning device.

4. The cleaning device as recited in claim 1 further comprising at least one squeegee in a radial flare shape on the inlet of the cleaning nozzle for dislodging debris from the cooling tower sump using a scrubbing movement of the squeegee against the sump causing debris to rise into suspension in the water for transferring by siphon through the cleaning device.

5. The cleaning device as recited in claim 1 wherein said extension tube has a length of from one quarter to one third the width of the cooling tower sump for accommodation by an operator.

6. The cleaning device as recited in claim 1 wherein said extension tube further comprises, said first length from 75 to 80 percent longer than the second length, the size and length difference slightly increasing the velocity within the second length for a short duration to maintain suspension of debris within the sump water.

7. The cleaning device as recited in claim 1 wherein said drain hose further comprises, a clear flexible hose permitting visual indication of the effectiveness of the cleaning device indicating the amount and type of debris in suspension in the sump water.

8. The cleaning device as recited in claim 7 wherein the drain hose is formed of a thermoplastic material.

* * * * *